US005300726A

United States Patent [19]

Miyamoto

[11] Patent Number: 5,300,726

[45] Date of Patent: Apr. 5, 1994

[54] ELECTRONIC RHYTHM INSTRUMENT WITH TONE PITCH AND TONE VOLUME CONTROL

[75] Inventor: Hiromu Miyamoto, Hamamatsu, Japan

[73] Assignee: Yamaha Corporation, Hamamatsu, Japan

[21] Appl. No.: 762,805

[22] Filed: Sep. 20, 1991

Related U.S. Application Data

[63] Continuation of Ser. No. 443,463, Nov. 29, 1989, abandoned.

[30] Foreign Application Priority Data

Nov. 30, 1988 [JP] Japan ..... 63-303552

[51] Int. Cl.[5] ..... G10H 1/40

[52] U.S. Cl. ..... 84/611; 84/635; 84/651; 84/667; 84/DIG. 12

[58] Field of Search ..... 84/611, 635, 651, 667, 84/DIG. 12; 84/477 R

[56] References Cited

U.S. PATENT DOCUMENTS

| | | | |
|---|---|---|---|
| 4,305,319 | 12/1981 | Linn | 84/611 |
| 4,440,057 | 3/1984 | Ishibashi | 84/622 |
| 4,672,876 | 6/1987 | Sugiyama et al. | 84/635 |
| 4,713,996 | 12/1987 | Oguri | 84/DIG. 12 |
| 4,732,467 | 2/1988 | Kato | 84/DIG. 12 |
| 4,742,748 | 5/1988 | Tateishi | 84/477 R X |
| 4,867,028 | 9/1989 | Jones | 84/DIG. 12 |
| 4,957,032 | 9/1990 | Hirano et al. | 84/617 |

*Primary Examiner*—William M. Shoop, Jr.
*Assistant Examiner*—Brian Sircus
*Attorney, Agent, or Firm*—Spensley Horn Jubas & Lubitz

[57] ABSTRACT

An electronic rhythm instrument having two or more rhythm switches which correspond to rhythmical sounds, and which generates rhythmical sounds corresponding to the rhythm switch operated. In the electronic rhythm instrument, one of the rhythmical sounds can be assigned commonly to a plurality of the rhythm switches, and further, a tone pitch and/or a tone volume can be assigned to each rhythm switch to which one of the rhythmical sounds is assigned commonly when a primary mode is selected. After the assignment, when a secondary mode is selected and one of the rhythm switches is operated, the preassigned rhythmical sound having the tone pitch and/or the tone volume assigned to the operated rhythm switch can be generated. The present invention can assign a tone-pitch scale and/or a tone-volume scale to a number of rhythm switches. When the tone-pitch scale is assigned to the rhythm switches, a melody can be produced according to the tone-pitch scale. When the tone-volume scale is assigned to the rhythm switches, a more expressive percussion performance is achieved than in a conventional instrument.

16 Claims, 11 Drawing Sheets

FIXED DATA

REGISTERS (a)

SELECT VOICE
MULTI #234

(b)

SELECT VOICE
BD #234

(c)

PITCH 00 +11
BD 1#34

(d)

PITCH 01 +12
BD 1#34

(e)

PITCH 02 +13!
BD 1#34

(f)

ACCSTEP = +1
BD 12#4

(g)

ACCSTEP = +4!
BD 12#4

FIG.12

ELECTRONIC RHYTHM INSTRUMENT WITH TONE PITCH AND TONE VOLUME CONTROL

This is a continuation of application Ser. No. 07/443,463, filed on Nov. 29, 1989, now abandoned.

BACKGROUND OF THE INVENTION

1. Field of the Invention

The present invention relates to electronic rhythm instruments which can generate rhythmical sounds when rhythm switches on a panel are operated.

2. Prior Art

A conventional rhythm instrument is described in the U.S. Pat. No. 4,672,876. In this rhythm instrument, each key on the keyboards is used as a rhythm switch. For example, each rhythmical sound, such as that of tom-toms, and bass drum, etc., is assigned to one of the keys on the upper keyboard, and when one of the keys is depressed, the rhythmical sound assigned to the key is produced. Moreover, a function to assign a rhythmical sound to a desired key on the lower keyboard is provided for. This makes it possible for a performer to reassign rhythmical sounds to keys most convenient to the performer. The rhythm performance by means of rhythm switches (i.e., keys on the keyboards) is called hand-percussion.

However, the conventional instrument is not provided with a function to control tone pitches o tone volumes of the rhythmical sounds.

SUMMARY OF THE INVENTION

It is therefore an object of the present invention to provide an electronic rhythm instrument in which tone pitches or tone volumes of rhythmical sounds can be assigned to rhythm switches provided for selecting the type of rhythmical sound.

In an example of an electronic rhythm instrument according to the invention, the instrument has a plurality of rhythm switches which correspond to a plurality of rhythmical sounds. The instrument generates the rhythmical sound corresponding to the rhythm switch operated. The instrument includes rhythm-sound-setting apparatus which sets one of the plurality of rhythmical sounds in such a manner that the set rhythmical sound is common to at least two of the plurality of rhythm switches. Primary-mode-setting apparatus sets a primary mode of operation of the instrument, while secondary-mode-setting apparatus sets a secondary mode of operation of the instrument. Assigning apparatus includes tone pitch control data apparatus for assigning a tone pitch of a series of tone pitches to each of said at least two rhythm switches, when the primary mode is detected. Shifting apparatus equally shifts all of the series of tone pitches by an arbitrary pitch amount, so that the assigned tone pitch is shifted by the arbitrary pitch amount. Rhythm-sound generating apparatus generates the set rhythmical sound having the assigned tone pitch corresponding to an operated rhythm switch form among the at least two rhythm switches, when the secondary mode is selected. The instrument includes apparatus for storing reference data indicative of a specific tone pitch, apparatus for comparing the stored reference data with the assigned tone pitch, and apparatus for providing an indication when the assigned tone pitch is greater than the reference data.

In accordance with the invention, the rhythm-sound-setting apparatus may include a register into which rhythmical sound data designated by one of the rhythm switches is written. The primary-mode setting apparatus may comprise a mode-setting switch for selecting a multi-assign-process routine in which a series of tone pitches is respectively assigned to each rhythm switch.

Still further in accordance with the invention, the instrument may include storing apparatus for storing sound data representing the rhythmical sound. The secondary-mode setting apparatus may comprise a keyboard-percussion mode-setting switch, a step-input mode-setting switch, or an auto-rhythm mode-setting switch. The keyboard-percussion mode-setting switch designates a keyboard-percussion mode in which rhythmical sound is generated each time one of the rhythmic switches is operated. The step-input mode-setting switch designates a step-input mode in which rhythmical sound is generated and sound data representing the generated rhythmical sound are stored into the storing apparatus each time one of the rhythmic switches is operated. The auto-rhythm mode-setting switch designates an auto-rhythm mode in which rhythmical sounds are reproduced which are stored each time one of the rhythmic switches is operated.

Still further in accordance with the invention, the instrument may include a data-changing switch for changing tone-pitch-control data respectively assigned to the plurality of rhythm switches.

FIG. 12 is a set of front views showing display examples on LCD 4.

DESCRIPTION OF THE PREFERRED EMBODIMENT

The invention will now be described with reference to the accompanying drawings.

Figure 2:
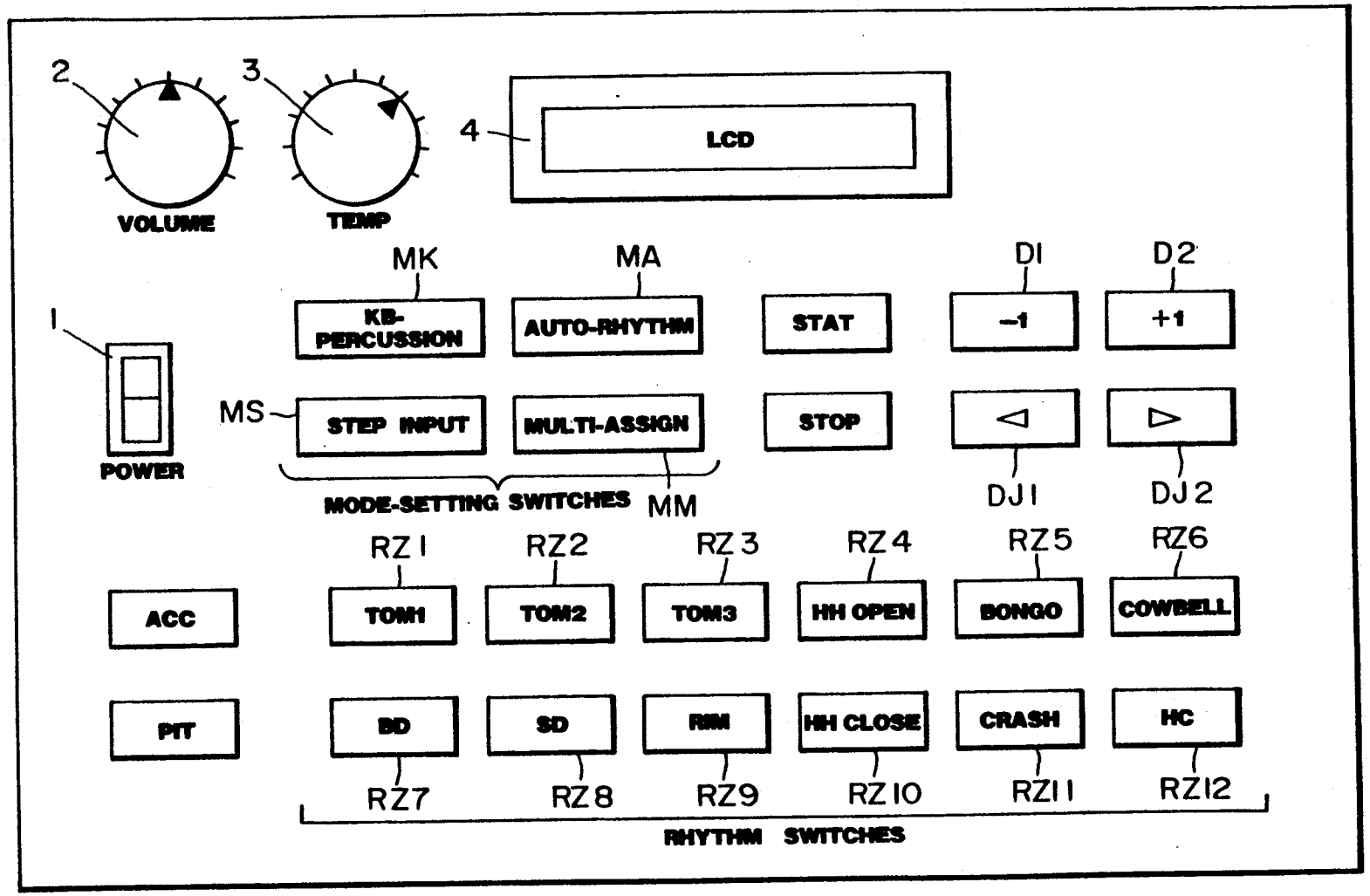
FIG. 2 is a front, view of the operating panel of the embodiment of the present invention.

First, operation modes of the electronic rhythm instrument of the embodiment will be described with reference to FIG. 2 showing the operating panel of the rhythm instrument.

On this panel, the following elements are provided: power switch 1, variable resistor 2 for controlling tone volume, variable resistor 3 for controlling tempo of auto-rhythm performance, and LCD (Liquid-Crystal Display) 4; mode-setting switches MK, MS, MA, and MM; start switch STAT and stop switch STOP; data-changing switches D1 and D2; job-changing switches DJ1 and DJ2; accent switch ACC and pitch switch PIT; and rhythm switches RZ1 to RZ12.

The rhythm instrument has four operation modes as follows:

(A) KB(KEYBOARD) PERCUSSION MODE

When mode-setting switch MK is depressed, KB percussion mode is set and the indicator lamp in the switch turns on. In this operation mode, when a performer depresses one of the rhythm switches RZ1 to RZ12, the rhythmical sound corresponding to the depressed switch is produced. For example, when rhythm switch RZ2 is depressed, sounds of tom-toms 2 are produced, whereas when rhythm switch RZ7 is depressed sounds of a bass drum are produced.

When one of the rhythm switches RZ1 to RZ12 is depressed with accent switch ACC on, a preset rhythmical sound is produced at the tone volume preassigned to the rhythm switch depressed. In other words, rhythm switches RZ1 to RZ12 function as tone-volume-designation switches.

On the other hand, when one of the rhythm switches RZ1 to RZ12 is depressed with pitch switch PIT on, a preset rhythmical sound is produced at the tone pitch preassigned to the rhythm switch depressed. In other words, rhythm switches RZ1 to RZ12 function as tone-pitch-designation switches. Incidentally, the difference of pitches between the rhythmical sounds designated by two adjacent rhythm switches is 100 cent (i.e., a semitone).

(B) STEP-INPUT MODE

When mode-setting switch MS is depressed, step-input mode is set and the indicator lamp in the switch turns on. In the step-input mode, rhythm pattern is entered as follows:

First, when accent switch ACC and pitch switch PIT are in the OFF state, a prestored rhythmical sound corresponding to the depressed rhythm switch is stored in sequence into the memory each time the performer depresses one of rhythm switches RZ1 to RZ12. In this case, the tone pitch and the tone volume of the rhythmical sound are at the standard levels, and data that represent the levels are stored together with the rhythmical sound data.

Second, when accent switch ACC is in the ON state and pitch switch PIT is in the OFF state, the prestored rhythmical sound of a tone volume corresponding to the depressed rhythm switch is stored in sequence into the memory each time the performer depresses one of rhythm switches RZ1 to RZ12. In this case, the tone pitch is at the standard level, whereas the tone volume is at the level designated by the depressed rhythm switch. In other words, rhythm switches RZ1 to RZ12 are used as tone-volume-designation switches. The data that represent the levels above are stored together with the rhythmical sound data.

Third, when accent switch ACC is in the OFF state and pitch switch PIT is in the ON state, the prestored rhythmical sound of a tone pitch corresponding to the depressed rhythm switch is stored in sequence into the memory each time the performer depresses one of rhythm switches RZ1 to RZ12. In this case, the tone pitch is at the level designated by the depressed rhythm switch, whereas the tone volume is at the standard level. In other words, rhythm switches RZ1 to RZ12 are used as tone-pitch-designation switches. The data that represent the levels above are stored together with the rhythmical sound data.

(C) AUTO-RHYTHM MODE

When mode-setting switch MA is depressed, the auto-rhythm mode is set and an indicator lamp in the switch turns on. In the auto-rhythm mode, automatic performance is carried out according to the rhythm pattern entered in the step-input mode, when the start switch STAT is turned on. The automatic performance stops when stop switch STOP is turned on.

(D) MULTI-ASSIGN MODE

When mode-assign switch MM is turned on, the multi-assign mode is set and an indicator lamp in the switch turns on. As described above, rhythm switches RZ1 to RZ12 are used as tone-volume-designation switches or tone-pitch-designation switches when accent switch ACC or pitch switch PIT is in the ON state. In the multi-assign mode, tone-volume-control data of 12-steps and tone-pitch-control data of 12-steps can be assigned to rhythm switches RZ1 to RZ12, each of which is also used to specify a type of rhythmical sound.

Figure 1:
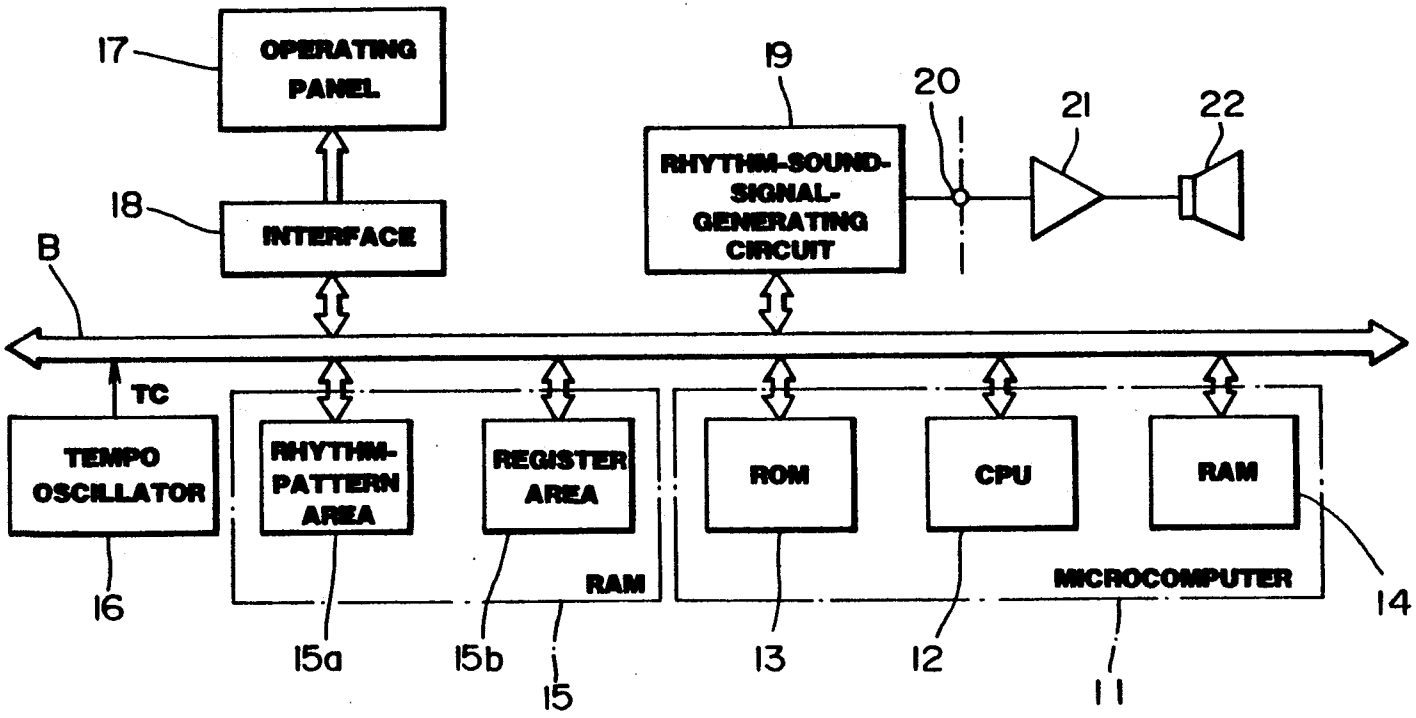
FIG. 1 is a block diagram of an electronic rhythm instrument according to the embodiment of an present invention.
Figure 3:
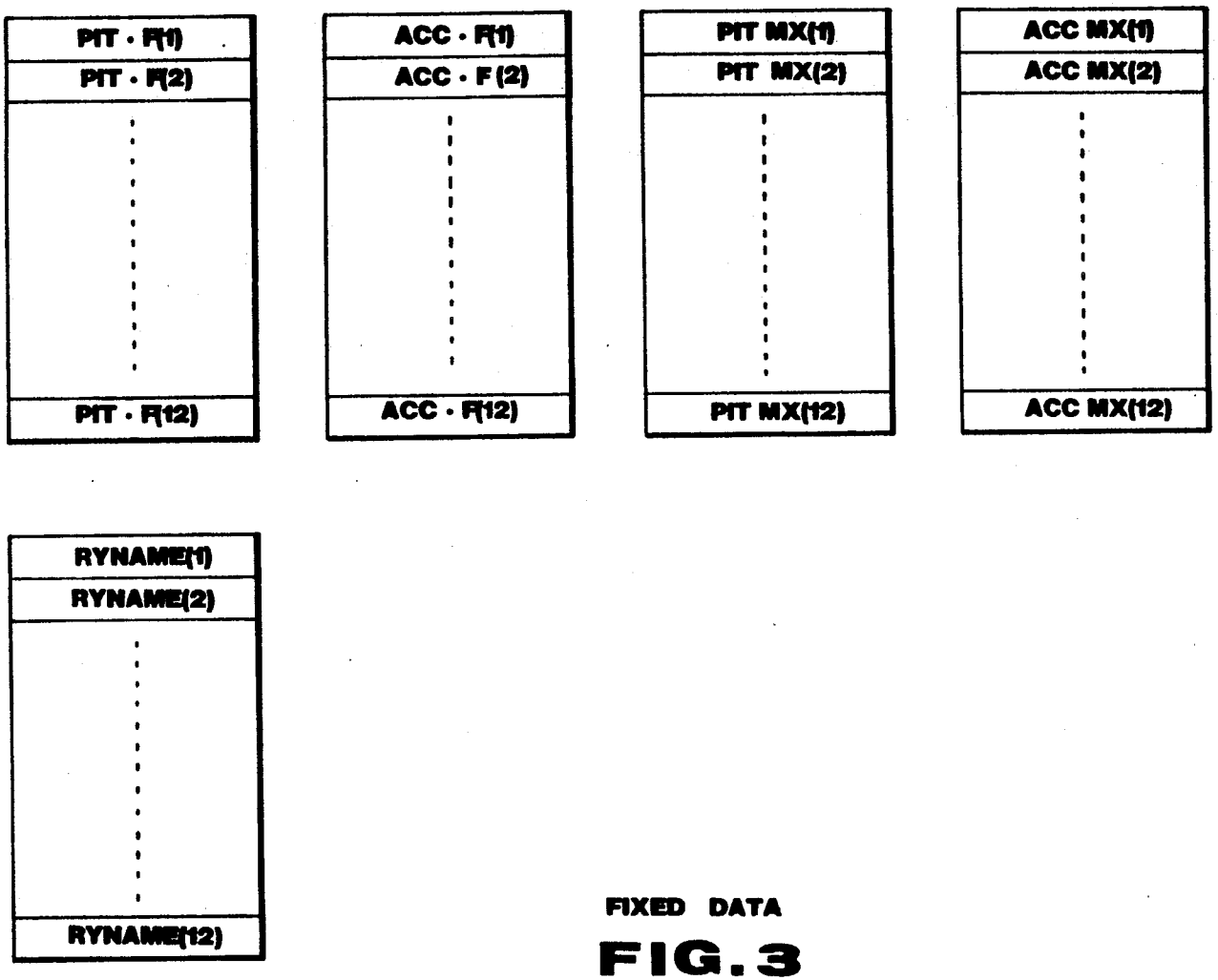
FIG. 3 is a set of tables showing the fixed data stored in ROM 13.
Figure 4:
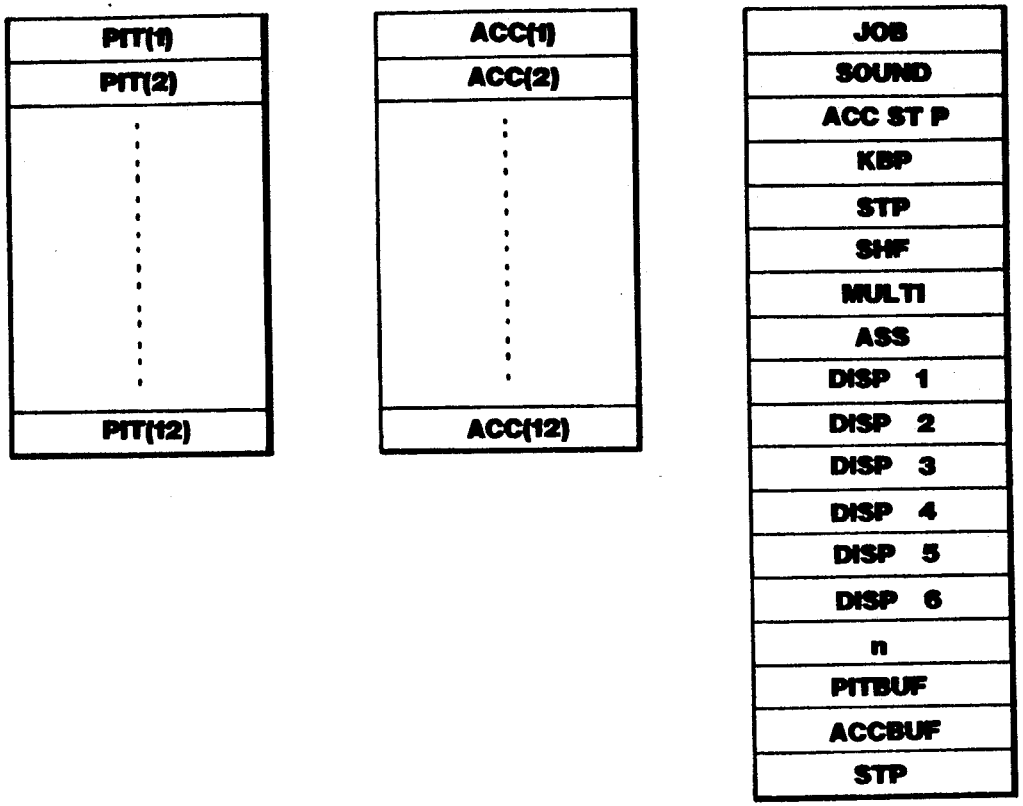
FIG. 4 is a set of tables showing the registers allocated in RAM 15.

In FIG. 1, microcomputer 11 consists of CPU (Central Processing Unit) 12, ROM 13 for storing programs and fixed data, and RAM 14 for storing temporal data. FIG. 3 shows the fixed data prestored in ROM 13. These data are set corresponding to each rhythm switch RZk (k=1 to 12) and the contents of the data are as follows:

PIT.F(k): standard pitch data
ACC.F(k): standard volume data
PITMX(k): maximum pitch data
ACCMX(k): maximum volume data
RYNAME(k): rhythm name data RAM 15 in FIG. 1 has rhythm-pattern area 15*a* in which rhythm patterns are stored and register area 15*b* in which various registers are allocated. FIG. 4 show the registers in register area 15*b*. Each register PIT(k) is provided for storing tone-pitch-control data assigned to rhythm switch RZk, whereas each register ACC(k) is provided for storing tone-volume-control data assigned to rhythm switch RZk. Registers DISP1 to DISP6 are used for storing display data. The other registers will be explained later in the description of the operation of the embodiment.

Tempo oscillator 16 generates tempo clock TC which is used as the basis for timing the auto-rhythm performance, and feeds the tempo clock TC to bus line B. The components 17 on the operating panel shown in FIG. 2 are connected to bus line B via interface circuit 18. Interface circuit 18 includes a driver circuit for driving LCD 4.

Rhythm-sound-signal-generating circuit 19 generates rhythm-sound signals on the basis of rhythm-sound number, tone-volume data, and tone-pitch data fed via bus line B. The rhythm-sound signal produced from rhythm-sound-signal-generating circuit 19 is fed to amplifier 21 via output terminal 20 and a cable. Amplifier 21 drives speaker 22 so that speaker 22 produces rhythmical sounds on the basis of the rhythm-sound signals.

The operation of CPU 12 will be described with reference to flowcharts in FIG. 5 to FIG. 11.

(1) MAIN ROUTINE

Figure 5:
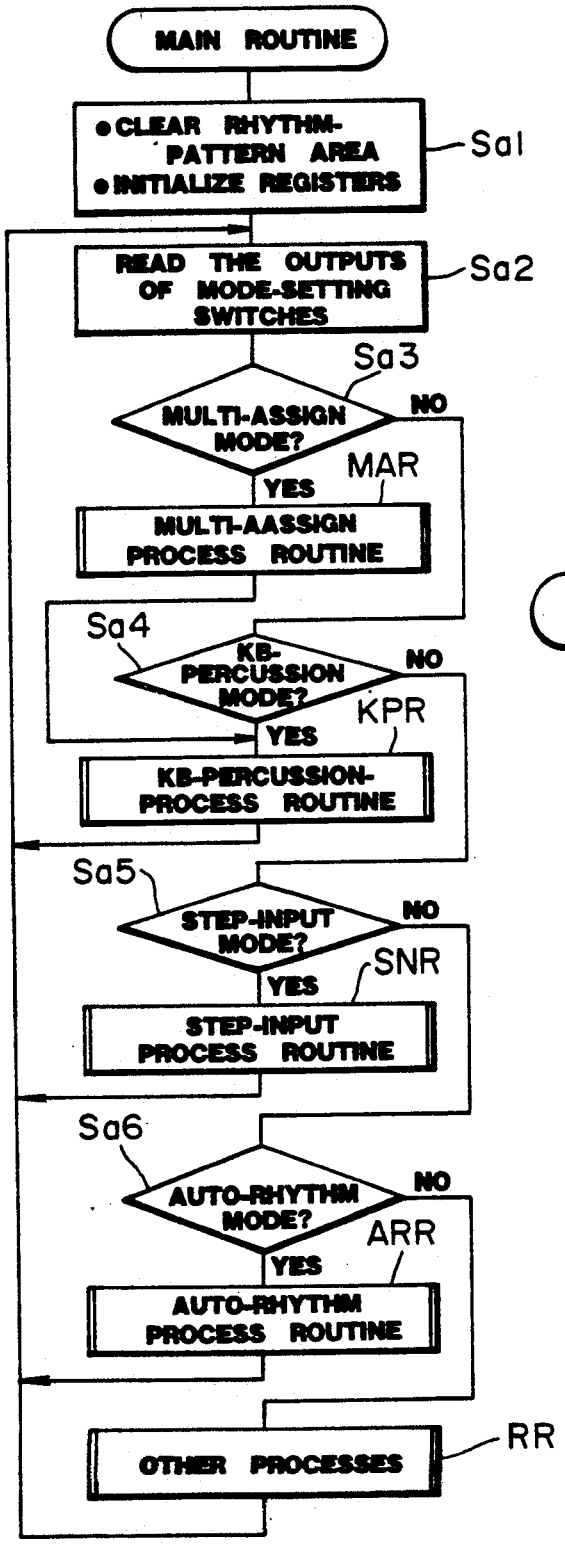
FIG. 5 is a flowchart of a main processing routine.

FIG. 5 is a flowchart of a main routine. When power switch 1 is turned on, the processing of CPU 12 proceeds to step Sa1. At step Sa1, rhythm-pattern area 15*a* of RAM 15 is cleared, and the registers in register area 15*b* are initialized: registers JOB, ACCSTP, and ASS are initialized to "1", while the other registers are initialized to "0".

Figure 10:
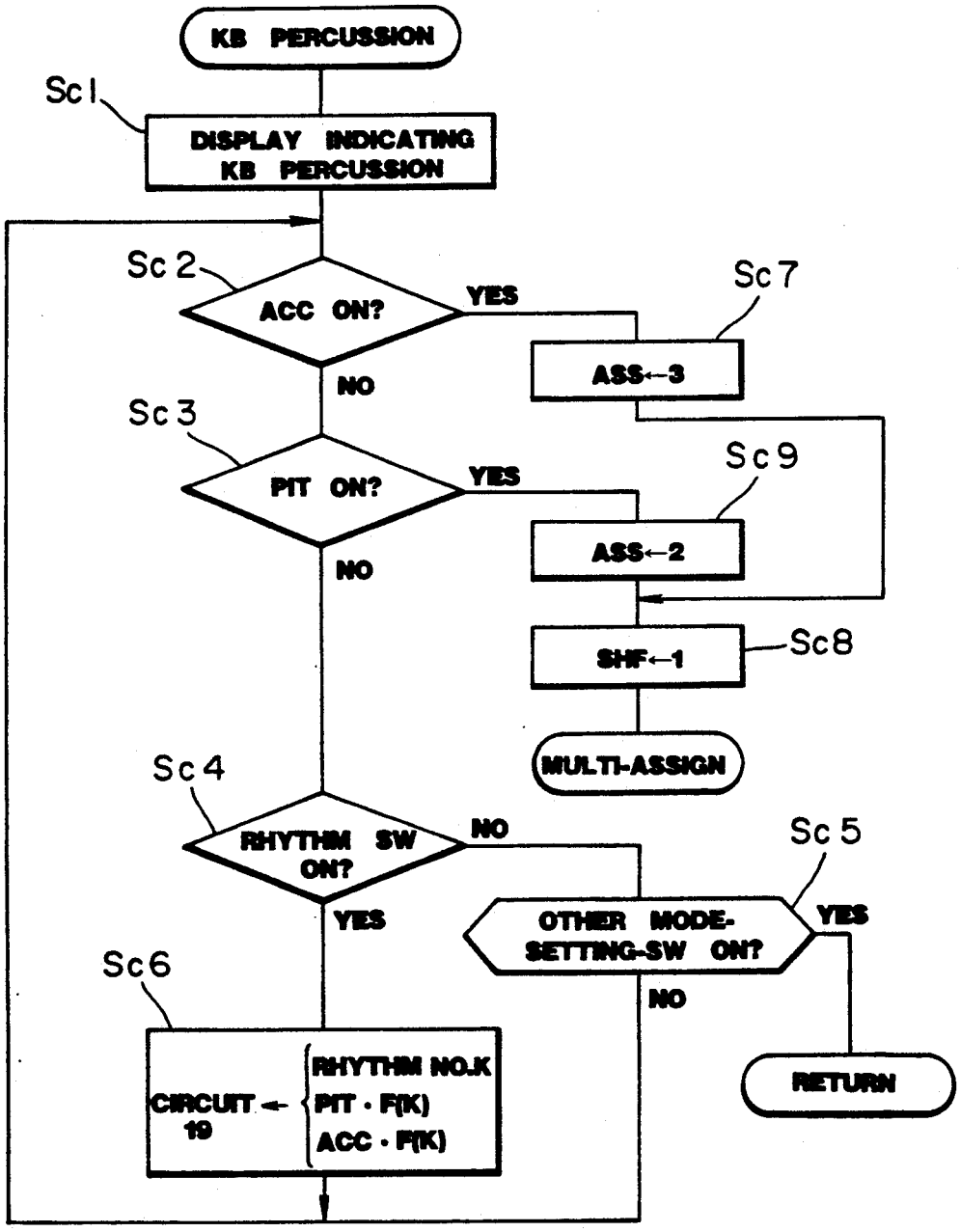
FIG. 10 is a flowchart of a KB-percussion-process routine.
Figure 11:
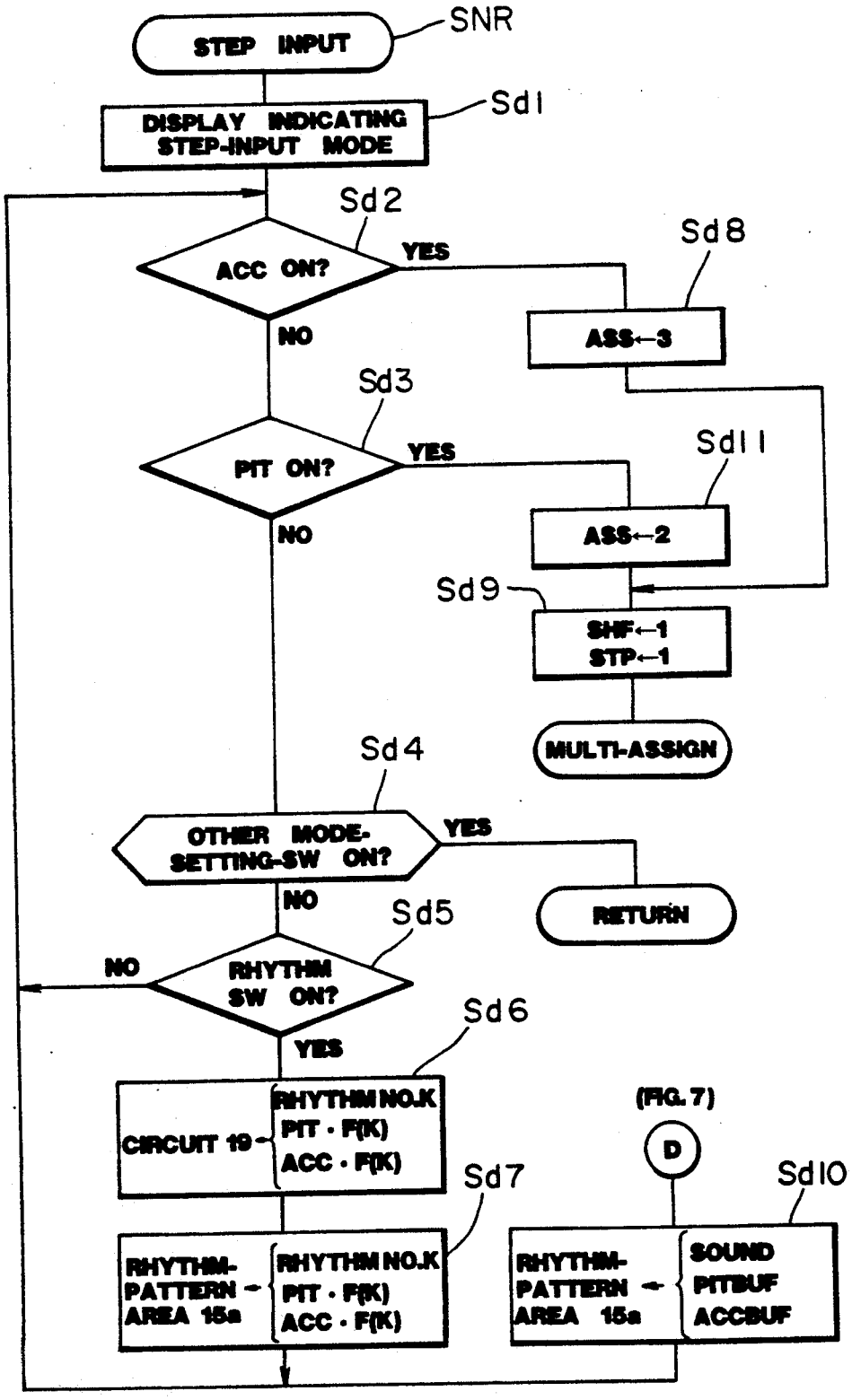
FIG. 11 is a flowchart of a step-input-process routine.

At step Sa2, the outputs of mode-setting switches MK, MS, MA, and MM are read into RAM 14. At step Sa3, the current mode is tested to determine if it is in the multi-assign mode (i.e., if mode-setting switch MM is on). If the test result at step Sa3 is "YES", the processing proceeds to multi-assign-process routine MAR shown in FIG. 6 to FIG. 9. If the test result at step Sa3 is "NO", the processing proceeds to step Sa4. At step Sa4, the current mode is tested to determine if it is in the KB-percussion mode (i.e., if mode-setting switch MK is on). If the test result at step Sa4 is "YES", KB-percussion-process routine KPR in FIG. 10 is executed, whereas if the test result at step Sa4 is "NO", the processing proceeds to step Sa5 at which the current mode is tested to determine if it is in the step-input mode (i.e., if mode-setting switch MS is on). If the test result at step Sa5 is "YES", step-input-process routine SNR in FIG. 11 is executed, whereas if the test result is "NO", the processing proceeds to step Sa6 at which the current mode is tested to determine if it is in the auto-rhythm mode (i.e., if mode-setting switch MA is on). If the test result at step Sa6 is "YES", auto-rhythm-process routine ARR is executed, whereas if the test result is "NO", the processing proceeds to routine RR at which various required processes are carried out. After that, the processing loops back to step Sa2 and the processes above are repeated.

Next, routines MAR, KPR, SNR and ARR will be described.

(2) MULTI-ASSIGN-PROCESS ROUTINE MAR

Multi-assign-process routine MAR is shown in the flowcharts in FIG. 6 to FIG. 9. The multi-assign-process routine MAR contains three major process routines, and one of the three routines designated by the data in register JOB in RAM 15 is executed. The three process routines will now be described.

(2-1) RHYTHM-SOUND-SETTING ROUTINE

In the rhythm-sound-setting routine, the type of rhythmical sound to be generated is set into register SOUND. As described above, rhythm switches RZ1 to RZ12 are used as tone-volume-designation switches or tone-pitch-designation switches, and in such cases, the rhythmical sound generated or registered in rhythm-pattern area 15*a* is the sound designated by register SOUND.

Figure 6:
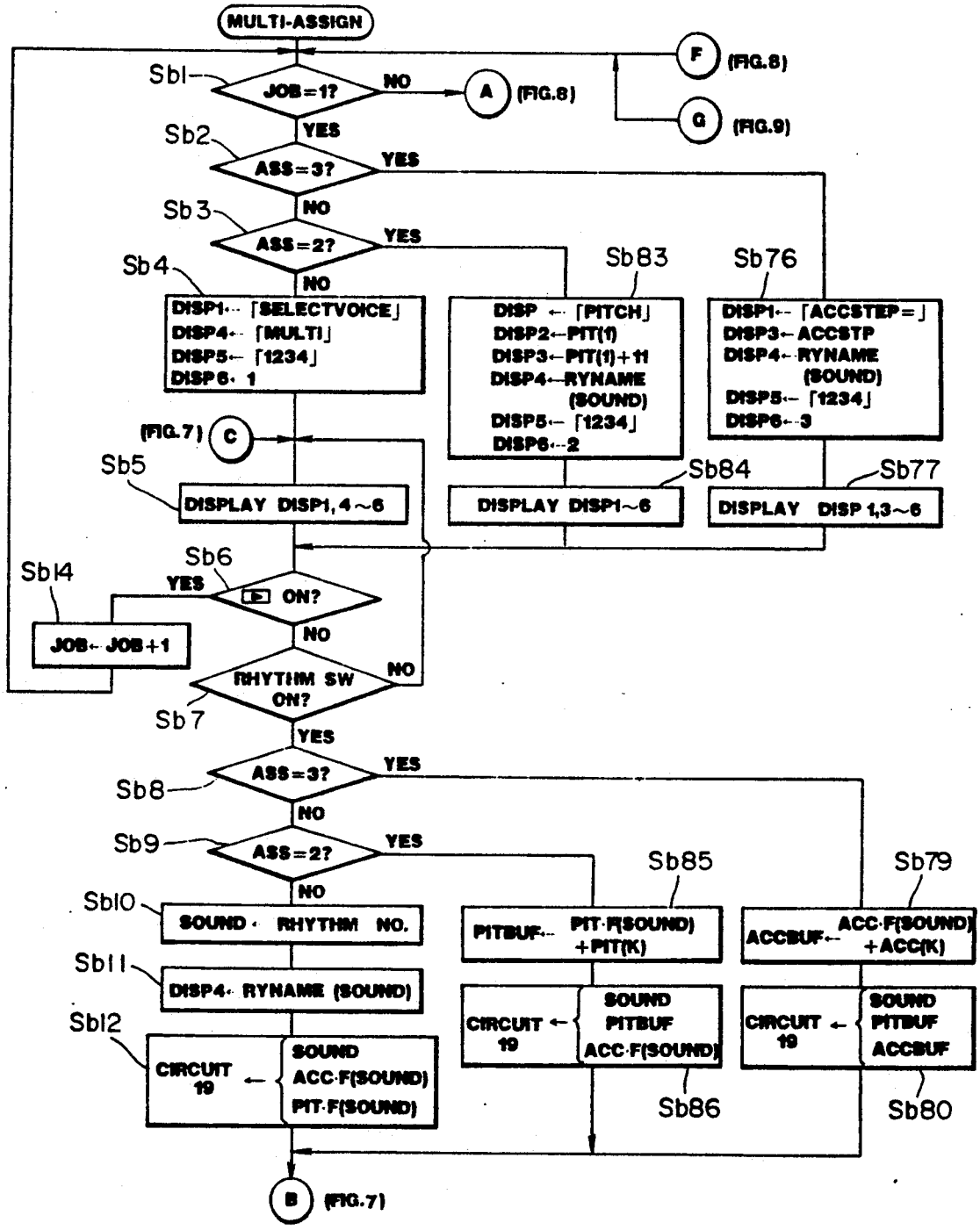
FIG. 6 is a flowchart of a rhythm-sound-setting routine in multi-assign-process routine.

When the processing of CPU 12 proceeds to step Sb1 of multi-assign-process routine MAR in FIG. 6, the content of register JOB in RAM 15 is tested to determine if it is "1" or not. In the initial situation, the content of register JOB has been set to "1", and so the test result at step Sb1 is "YES", and the processing proceeds to step Sb2. At step Sb2, the content of register ASS is tested to determine if it is "3" or not. Since the content of the register ASS has been initialized to "1", the test result at step Sb2 is "NO", and the processing proceeds to step Sb3 at which the content of register ASS is tested to determine if it is "2". If the test result is "NO" as in this case, the processing proceeds to step Sb4.

At step Sb4, character strings "SELECT VOICE", "MULTI", "1234" are set into registers DISP1, DISP4 and DISP5, respectively, and "1" is set to register DISP6. After that, at step Sb5, the contents of registers DISP1, 4, 5, 6 are supplied to LCD (Liquid-Crystal Display) 4 on the operating panel via interface circuit 18. Thus, LCD 4 displays the information shown in FIG. 12 (*a*). The content of register DISP6 indicates which of the numerals in register DISP5 blinks. In FIG. 12, the blinking digit is designated by "#".

At step Sb6, job-changing switch DJ2 is tested to determine if it is in the ON state. If the test result at step Sb6 is "NO", the processing proceeds to step Sb7 at which rhythm switches RZ1 to RZ12 are tested to determine if any of the switches is turned on. If the test result at step Sb7 is "NO", the processing loops back to step Sb5, and steps Sb5 to Sb7 are repeatedly carried out until job-changing switch DJ2 or one of rhythm switches RZ1 to RZ12 is operated.

When the performer depresses one of the rhythm switches RZ1 to RZ12 so as to designate the intended rhythmical sound, the test result at step Sb7 becomes "YES", and the processing proceeds to step Sb8 at which the content of register ASS is tested to determine if it is "3". If the test result at step Sb8 is "NO", the processing proceeds to step Sb9 at which the content of register ASS is tested to determine if it is "2". If the test result at step Sb9 is "NO", the processing proceeds to step Sb10 at which the rhythm number associated with the rhythm switch turned on is written into register SOUND. For example, when rhythm switch RZ7 is turned on, the rhythm number "7" of the bass drum is written into register SOUND. After that, at step Sb11, the rhythm name corresponding to the rhythm number in register SOUND is written into register DISP4.

At step Sb12, the following data are supplied to rhythm-sound-signal-generating circuit 19: the rhythm number in register SOUND; standard tone-volume data ACC.F(SOUND) corresponding to the rhythm number in register SOUND (see FIG. 3); and standard tone-pitch data PIT.F(SOUND) corresponding to the rhythm number in register SOUND. Hence, the rhythmical sound designated by the rhythm number in register SOUND is generated at the standard tone volume and tone pitch. At step Sb13 in FIG. 7, the content of register SHF is tested to determine if it is "1" or not. Since the content of register SHF has been initialized to "0", the test result at step Sb13 is "NO", and the processing loops back to step Sb5 in FIG. 6. At step Sb5, the contents of registers DISP1, DISP4 to DISP6 are supplied to LCD 4. Since the content of register DISP4 has been altered at step Sb11 in this case, the information of (b) in FIG. 12, for example, is displayed.

The above is the routine for setting the type of rhythmical sound to be generated into register SOUND. After that, step Sb5 to Sb7 is repeated until the performer takes the next action. When the performer depresses job-changing switch DJ2, the test result at step Sb6 becomes "YES", and the processing proceeds to step Sb14 at which the content of register JOB is incremented by 1 (to "2" in this case). After that, the processing loops back to step Sb1.

(2-2) TONE-PITCH-CONTROL-DATA-ASSIGNING ROUTINE

A tone-pitch-control-data-assigning routine is provided for assigning tone-pitch-control data (differential data) to rhythm switches RZ1 to RZ12. More specifically, the routine sets tone-pitch-control data into registers PIT(1) to PIT(12) in FIG. 4, each of which corresponds to one of the rhythm switches RZ1 to RZ12.

Figure 8:
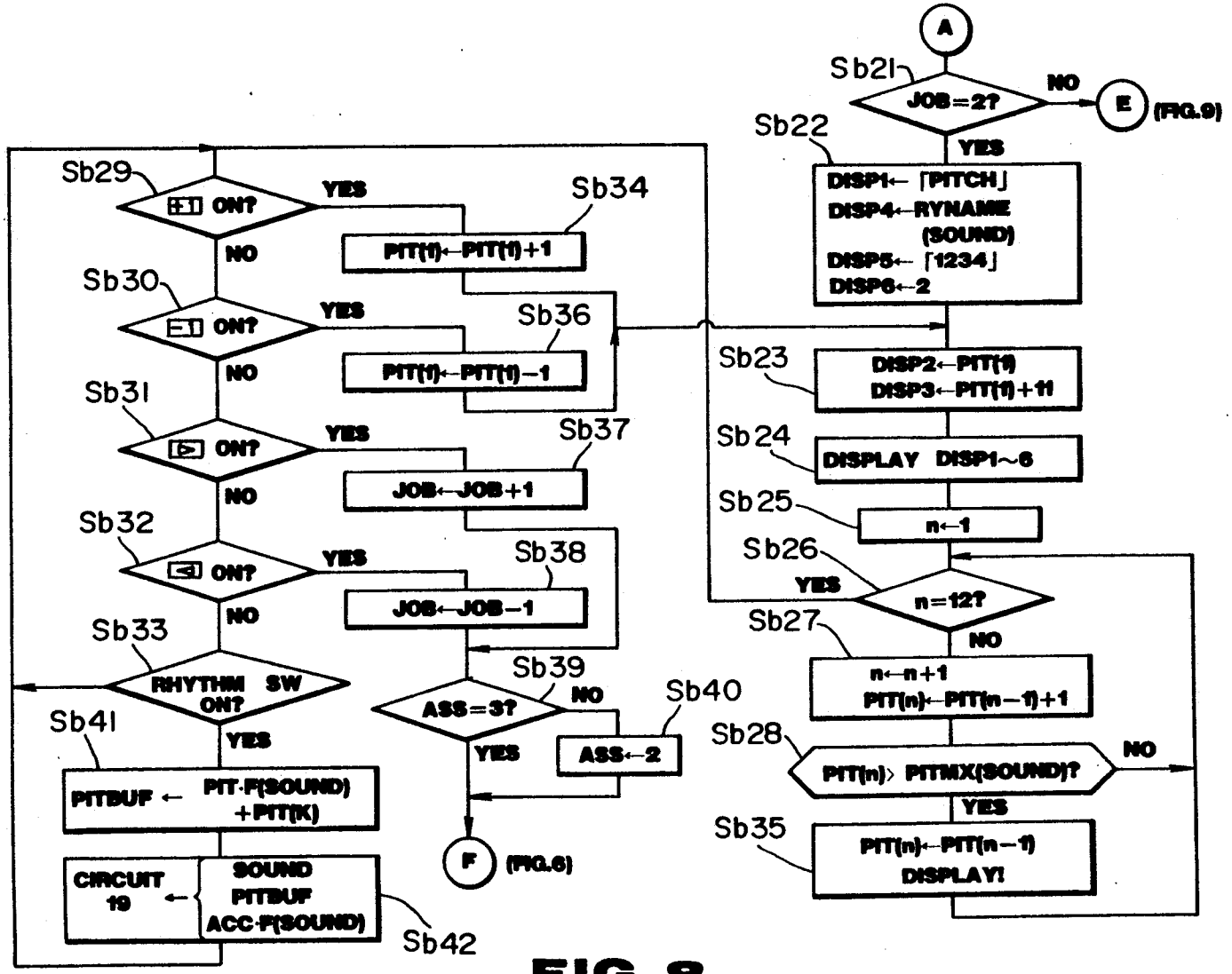
FIG. 8 is a flowchart of a tone-pitch-control-data-assigning routine in multi-assign-process routine.
Figure 9:
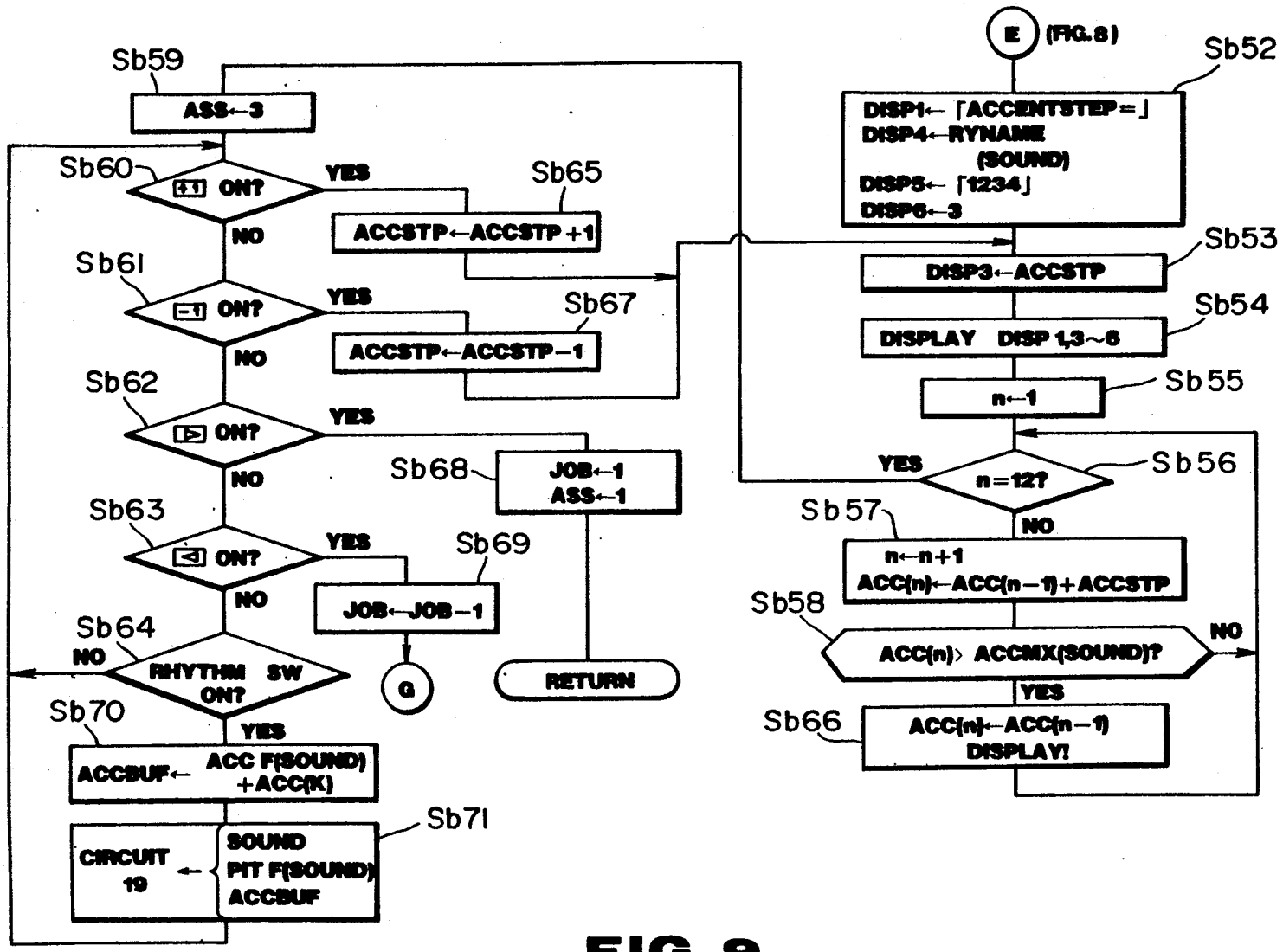
FIG. 9 is a flowchart of a tone-volume-control-data-assigning routine in multi-assign-process routine.

When the processing loops back to step Sb1 with the content of register JOB being "2", the test result at step Sb1 is "NO", and the processing proceeds to step Sb21 in FIG. 8. At step Sb21, the content of register JOB is tested to determine if it is "2". In this case, the test result is positive (YES), and so the processing proceeds to step Sb22. At step Sb22, a character string "PITCH" is written into register DISP1, the rhythm name associated with the rhythm number in register SOUND is written into register DISP4, a numerical string "1234"

is written into DISP5, and "2" is written into register DISP6. At step Sb23, the content of register PIT(1) is written into register DISP2, and the sum total of "PIT(1)+11" is written into register DISP3. Since the content of register PIT(1) has been initialized to "0", data of "0" and "11" are written into registers DISP2 and DISP3, respectively. At step Sb24, the contents of registers DISP1 to DISP6 are supplied to LCD 4, and hence the information of (c) in FIG. 12 is displayed. After that the processing proceeds to step Sb25 at which data of "1" is set into register n.

At step Sb26, the content of register n is tested to determine if it is "12" or not. If the test result is "NO", the processing proceeds to step Sb27. At step Sb27, first, the content of register n is incremented by 1 (resulting in "2"); second, "1" is added to the content of register PIT(n−1), and the result is written into register PIT(n). Since the content of PIT(1) is zero in this case, the content of PIT(2) will be "1" because "1" is added to "0". At step Sb28, the content of register PIT(n) (i.e., the content of PIT(2) in this case) is tested to determine if it is greater than the maximum pitch data PITMX-(SOUND) stored in ROM 13. The maximum pitch data PITMX(SOUND) is the maximum tone pitch data corresponding to the rhythm number stored in register SOUND. For example, when the rhythm number "5" is set in register SOUND, data PITMX(5) shown in FIG. 3 is read out to be compared with the content of register PIT(n). If the test result at step Sb28 is "NO", the processing loops back to step Sb26, thus steps Sb26 to Sb28 are repeatedly executed. As a result, data of 0, 1, . . . 11 are written into registers PIT(1) to PIT(12) respectively as tone-pitch-control data.

After that, the content of register n becomes 12 at step Sb27, and the processing proceeds from step 28 to step Sb26, and then to step Sb29. At step Sb29, data-changing switch D2 is tested to determine if it is turned on. If the test result at step Sb29 is "NO", the processing proceeds to step Sb30 at which data-changing switch D1 is tested to determine if it is turned on. If the test result at step Sb30 is "NO", the processing proceeds to step Sb31 at which job-changing switch DJ2 is tested to determine if it is turned on. If the test result at step Sb31 is "NO", the processing proceeds to step Sb32 at which job-changing switch DJ1 is tested to determine if it is turned on. If the test result at step Sb32 is "NO", the processing proceeds to step Sb33 at which rhythm switches RZ1 to RZ12 are tested to determine if one of them is turned on. If the test result at step Sb33 is "NO", the processing loops back to step Sb29, and steps Sb29 to Sb33 are repeatedly executed until one of the switches mentioned above is turned on.

When data-changing switch D2 is turned on, the test result at step Sb29 is "YES", and the processing proceeds to step Sb34 at which the content of register PIT(1) is incremented, resulting in "1" in this case. After that, steps Sb23 and Sb24 are executed so that the information of (d) in FIG. 12 is displayed. Subsequently, step Sb25 is executed followed by the repetition of steps Sb26 to Sb28 so that data of 1, 2, . . . 12 are written into registers PIT(1) to PIT(12) respectively, and again the processing proceeds to steps Sb29 to Sb33. When data-changing switch D2 is turned on again, data of 2, 3, . . . 13 are written into register PIT(1) to PIT(12) respectively, with the display responding to the data change.

Thus, each time data-changing switch D2 is turned on, the content of each register PIT(1) to PIT(12) is incremented by 1. During this process, if the data written into register PIT(n) exceeds data PITMX-(SOUND), the test result at step Sb28 becomes "YES", and the processing proceeds to step Sb35. At step Sb35, the content of register PIT(n−1) is written into register PIT(n) (the content of register PIT(n−1) is less than the content of register PIT(n) by 1, and is equal to data PITMX(SOUND) in this case). Hence, when the content of register PIT(n) reaches the maximum tone pitch data PITMX(SOUND), the data PITMX(SOUND) is written into register PIT(n) thereafter, and the mark "!" is displayed as shown in (e) in FIG. 12.

On the other hand, if data-changing switch D1 is turned on, the test result at step Sb30 is "YES", so that the processing proceeds to step Sb36 at which the content of register PIT(1) is decremented by 1. After that, the processing loops back to step Sb23, and steps Sb23 to Sb28 are executed thereafter. More specifically, the content of each register PIT(1) to PIT(12) is decremented by 1 with the display corresponding to the change.

Thus, the contents of registers PIT (1) to PIT(12) are set to desired values by operating data-changing switch D1 and D2.

Next, when job-changing switch DJ2 is turned on, the test result at step Sb31 is "YES", and the processing proceeds to step Sb37. At step Sb37, the content of register JOB is incremented to "3". At step Sb39, the content of register ASS is tested to determine if it is "3". If the test result at step Sb39 is "YES" as in this case, the processing loops back to step Sb1 in FIG. 6, whereas if the test result is "NO", the processing proceeds to step Sb40. At step Sb40, data of "2" is set into register ASS and the processing returns to step Sb1.

When job-changing switch DJ1 is turned on, the test result at step Sb32 is "YES", and the processing proceeds to step Sb38, at which the content of register JOB is decremented to "1". Then the processing proceeds to step Sb39.

When the performer wishes to listen to the tones generated according to the tone-pitch-control data which the performer has set in registers PIT(n) by operating data-changing switches D1 and D2, the performer depresses one of rhythm switches RZ1 to RZ12. When rhythm switch RZ3 is depressed, for example, the test result at step Sb33 is "YES", and the processing proceeds to step Sb41. At step Sb41, the content of register PIT(3) is added to the standard tone-pitch data PIT.F-(SOUND) (SOUND=3 in this case) in ROM 13, and the resultant sum is written into register PITBUF. At the next step Sb42, the following data are supplied to rhythm-sound-signal-generating circuit 19: the rhythm number in register SOUND; tone-pitch data in register PITBUF; and standard tone-volume data ACC.F-(SOUND) in ROM 13. As a result, rhythm-sound signals corresponding to these data are generated in rhythm-sound-signal-generating circuit 19, and the rhythmical sounds corresponding to the signals are produced from speaker 22. After completing step Sb42, the processing again loops back to Sb29.

(2-3) TONE-VOLUME-CONTROL-DATA-ASSIGNING ROUTINE

A tone-volume-control-data-assigning routine is provided for assigning tone-volume control data (differential data) to rhythm switches RZ1 to RZ12. More specifically, this routine assigns tone-volume-control data to registers ACC(1) to ACC(12) corresponding to rhythm switches RZ1 to RZ12, respectively.

After tone-pitch-control data have been set as described above, the performer depresses job-changing switch DJ2. As a result, the processing of CPU 12 proceeds to step Sb37 in FIG. 8, at which the content of register JOB is incremented by 1 to "3". Then the processing loops back to step Sb1 in FIG. 6 via steps Sb39 and Sb40. Since the test result at step Sb1 is "NO" in this case, the processing proceeds to step Sb21 in FIG. 8. The test result at step Sb21 is also "NO", and so the proceeding proceeds to step Sb52 in FIG. 9, which is the first step of the tone-volume-control-data-assigning routine.

At step Sb52, a character string "ACCENTSTEP=" is written into register DISP1, the rhythm name associated with the rhythm number in register SOUND is written into register DISP4, a numerical string "1234" is written into DISP5, and "3" is written into register DISP6. At step Sb53, the content of register ACCSTP is written into register DISP3. In this case, the content of register ACCSTP has been initialized to "1", and so the data of "1" is written into register DISP3. At step Sb54, the contents of registers DISP1, and DISP3 to DISP6 are supplied to LCD 4, and hence the information of (f) in FIG. 12 is displayed.

After that the processing proceeds to step Sb55 at which data of "1" is set into register n. Subsequently, steps Sb56 to Sb58 are repeatedly executed, so that data of 0, 1, . . . 11 are written into registers ACC(1) to ACC(12) respectively as tone-volume-control data. After that, the content of register n becomes 12, and so the test result at step Sb56 is "YES". Hence the processing proceeds to step Sb59, and data of "3" is set into register ASS. After that, steps Sb60 to Sb64 are repeatedly executed until one of the switches mentioned above is turned on.

When data-changing switch D2 is turned on, the test result at step Sb60 is "YES", and the processing proceeds to step Sb65 at which the content of register ACCSTP is incremented by 1. In this case, the content of register ACCSTP becomes "2", and the processing loops back to step Sb53. After that, steps Sb53 and Sb54 are executed so that the display is altered. Subsequently, steps Sb56 to Sb58 are repeatedly executed so that data of 0, 2, 4, . . . 22 are written into registers ACC(1) to ACC(12) respectively. When data-changing switch D2 is turned on again, data of 0, 3, 6, . . . 33 are written into register ACC(1) to ACC(12) respectively, and so on.

During the setting process of tone-volume-control data, if the data written into register ACC(n) exceeds the maximum tone-volume data ACCMX(SOUND) in ROM 13, the test result at step Sb58 is "YES", and the processing proceeds to step Sb66. At step Sb66, the content of register ACC(n-1) is written into register ACC(n). In other words, when the content of register ACC(n) exceeds the maximum tone-volume data ACCMX(SOUND), the maximum tone-volume data ACCMX(SOUND) is written into register ACC(n). In this case, the mark "!" is displayed as shown in (g) in FIG. 12.

On the other hand, if data-changing switch D1 is turned on, the test result at step Sb61 is "YES", so that the processing proceeds to step Sb67 at which the content of register ACCSTP is decremented by 1. After that, the processing loops back to step Sb53, and steps Sb53 to Sb58 are executed thereafter. When the content of register ACCSTP becomes "0" at step Sb67, for example, all the contents of registers ACC(1) to ACC(12) are set to "0", whereas when the content of register ACCSTP becomes "−1", the contents of registers ACC(1) to ACC(12) are 0, −1, −2, . . . −11, respectively.

Thus, the tone-volume-control data in registers ACC (1) to ACC(12) can be altered by operating data-changing switch D1 and D2.

When job-changing switch DJ2 is turned on, the processing proceeds to step Sb68 at which data "1" is set to registers JOB and ASS. After that, the processing returns to KB-percussion-process KPR in the main routine in FIG. 5.

When job-changing switch DJl is turned on, the processing proceeds to step Sb69, at which the content of register JOB is decremented by 1 (to "2"). Then the processing loops back to step Sb1. Thus, the tone-pitch-control-data-setting routine can be executed again.

When the performer wishes to listen to the tones generated according to the tone-volume-control data which the performer has set in registers ACC(n) by operating data-changing switches D1 and D2, the performer depresses one of rhythm switches RZ1 to RZ12. When rhythm switch RZ3 is depressed, for example, the test result at step Sb64 is "YES", and the processing proceeds to step Sb70. At step Sb70, the content of register ACC(3) is added to the standard tone-volume data ACC.F(SOUND) (SOUND=3 in this case) in ROM 13, and the resultant sum is written into register ACCBUF. At the next step Sb71, the following data are supplied to rhythm-sound-signal-generating circuit 19: the rhythm number in register SOUND; tone-volume data in register ACCBUF; and standard tone-pitch data PIT.F(SOUND) in ROM 13. As a result, rhythm-sound signals corresponding to these data are generated in rhythm-sound-signal-generating circuit 19, and the rhythmical sounds corresponding to the signals are produced from speaker 22. After completing step Sb71, the processing loops back to Sb60 again.

(3) KB-PERCUSSION-PROCESS ROUTINE KPR

FIG. 10 is a flowchart of the KB-percussion-process routine KPR. At step Sc1, information indicating that the current mode is the KB-percussion mode is displayed on LCD 4. At step Sc2, accent switch ACC (see FIG. 2) is tested to determine if it is turned on. If the test result at step Sc2 is "NO", the processing proceeds to step Sc3 at which pitch switch PIT is tested to determine if it is turned on. If the test result at step Sc3 is "NO", the process proceeds to step Sc4 at which rhythm switches RZ1 to RZ12 are tested to determine if one of the switches is turned on. If the test result at step Sc4 is "NO", the processing proceeds to step Sc5. At step Sc5, mode-setting switches MS, MA, MM (other than KB-percussion mode-setting switch MK) are tested to determine if one of the switches is turned on. If the test result at step Sc5 is "NO", the processing loops back to step Sc1. After that, steps Sc1 to Sc5 are repeatedly executed until one of accent switch ACC, pitch switch PIT, rhythm switches RZ1 to RZ12, and mode-setting switches MS, MA, MM is turned on.

When one of the rhythm switches RZ1 to RZ12, for example, switch RZ5 (bongo) is turned on, the test result at step Sc4 is "YES", and the processing proceeds to step Sc6. At step Sc6, the following data is supplied to rhythm-sound-signal-generating circuit 19: rhythm number "5" corresponding to rhythm switch RZ5 turned on; the standard tone-pitch data PIT.F(5) in ROM 13; and standard tone-volume data ACC.F(5) in ROM 13. As a result, the rhythm-sound signals which correspond to rhythm number "5" (bongo), and have a standard tone volume and a standard tone pitch, are generated and supplied to speaker 22 via amplifier 21. Thus, the rhythmical sound of a bongo is produced from speaker 22. Similarly, when rhythm switch RZ7 is turned on, for example, the rhythmical sound of a bass drum is produced, and when rhythm switch RZ1 is turned on, the rhythmical sound of tom-toms is produced.

When one of rhythm switches RZ1 to RZ12 is turned on in sequence, while maintaining accent switch ACC on, rhythm switches RZ1 to RZ12 function as tone-volume-designation switches. This operation will be described now.

When accent switch ACC is turned on, the test result at step Sc2 in FIG. 10 is "YES", and the processing proceeds to step Sc7 at which data of "3" is set into register ASS. At the next step Sc8, data of "1" is set to register SHF, and the processing proceeds to multi-assign-process routine MAR in FIG. 6.

In the multi-assign-process routine MAR, the processing proceeds to step Sb76 via steps Sb1 and Sb2. At step Sb76, a character string "ACCSTEP=" is written into register DISP1, the content of register ACCSTP is written into register DISP3, the rhythm name associated with the rhythm number in register SOUND is written into register DISP4, a numerical string "1234" is written into DISP5, and "3" is written into register DISP6. After that, at step Sb77, the contents of registers DISP1, and DISP3 to DISP6 are supplied to LCD 4, and hence the information of (f) in FIG. 12 is displayed.

When the processing proceeds to step Sb79 via steps Sb6, Sb7 and Sb8, the tone-volume-control data in register ACC(k) is added to the standard tone-volume data ACC.F(SOUND) in ROM 13, and the resultant sum is written into register ACCBUF. For example, when the rhythm number in register SOUND is "2", and the rhythm switch RZ7 is turned on, data ACC.F(2) and the content of register ACC(7) are added together. At the next step Sb80, the following data are supplied to rhythm-sound-signal-generating circuit 19: the rhythm number in register SOUND; tone-pitch data in register PITBUF; and tone-volume data in register ACCBUF. As a result, rhythm-sound signals corresponding to these data are generated in rhythm-sound-signal-generating circuit 19, and the rhythmical sounds corresponding to the rhythm switch RZk turned on are produced from speaker 22. After completing step Sb80, the processing proceeds to step Sb13 in FIG. 7.

Figure 7:
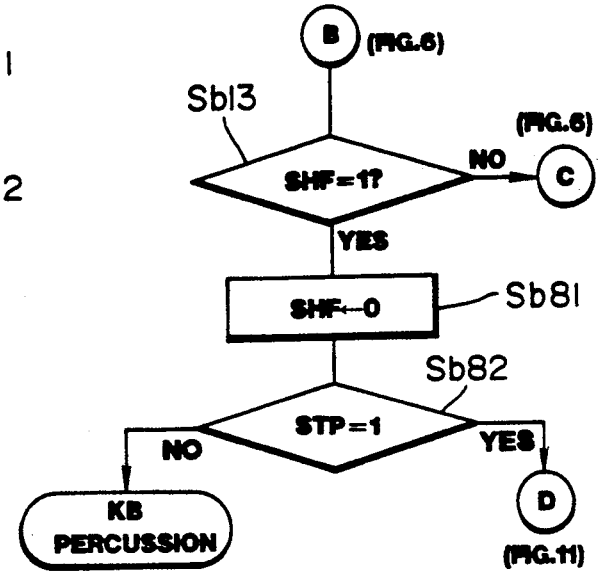
FIG. 7 is a flowchart of a final portion of the multi-assign-process routine.

At step Sb13 in FIG. 7, the content of register SHF is tested to determine if it is "1". In this case, the test result is "YES" (see step Sc8 in FIG. 10), and the processing proceeds to step Sb81 at which data "0" is written into register SHF. At step Sb82, the content of register STP is tested to determine if it is "1". Since register STP has been initialized to "0" in this case, the test result at step Sb82 is "NO", and the processing returns to KB-percussion-process routine in FIG. 10.

When one of rhythm switches RZ1 to RZ12 is turned on in sequence, while maintaining pitch switch PIT on, rhythm switches RZ1 to RZ12 function as tone-pitch-designation switches. More specifically, when pitch switch PIT is turned on, the test result at step Sc3 in FIG. 10 is "YES", and the processing proceeds to step Sc9 at which data of "2" is set into register ASS. At the next step Sc8, data of "1" is set to register SHF, and the processing proceeds to multi-assign-process routine MAR in FIG. 6.

In the multi-assign-process routine MAR, the processing proceeds to step Sb83 via steps Sb1, Sb2 and Sb3. At step Sb83, a character string "PITCH" is written into register DISP1, the content of register PIT(1) is written into register DISP2, the sum total of "11" and the content of register PIT(1) is written into register DISP3, the rhythm name associated with the rhythm number in register SOUND is written into register DISP4, a numerical string "1234" is written into DISP5, and "2" is written into register DISP6. After that, at step Sb84, the contents of registers DISP1 to DISP6 are supplied to LCD 4, and hence the information of (d) in FIG. 12 is displayed.

When the processing proceeds to step Sb85 via steps Sb6, Sb7, Sb8 and Sb9, the tone-pitch-control data in register PIT(k) is added to the standard tone-pitch data PIT.F(SOUND) in ROM 13, and the resultant sum is written into register PITBUF. At the next step Sb86, the following data are supplied to rhythm-sound-signal-generating circuit 19: the rhythm number in register SOUND; tone-pitch data in register PITBUF; and standard tone-volume data ACC.F(SOUND) in ROM 13. As a result, rhythm-sound signals having a tone pitch corresponding to the rhythm switch RZk turned on are generated in rhythm-sound-signal-generating circuit 19, and the rhythmical sounds corresponding to the switch RZk are produced from speaker 22. After completing step Sb86, the processing returns to KB-percussion-process routine in FIG. 10, via steps Sb13, Sb81, and Sb82 in FIG. 7.

The above describes the processing of CPU 12 in the KB-percussion mode. To transfer from the KB-percussion mode to another mode, it is sufficient to depress one of the mode-setting switches MS, MA, and MM. This produces the test result at step Sc5 of "YES", and the processing loops back to step Sa2 in FIG. 5.

(4) STEP-INPUT-PROCESS ROUTINE SNR

When mode-setting switch MS is turned on, the processing proceeds to step-input-process routine SNR. FIG. 11 is a flowchart of step-input-process routine SNR. At step Sd1, information indicating that the current mode is the step-input-process-routine mode is displayed on LCD 4. At step Sd2, accent switch ACC (see FIG. 2) is tested to determine if it is turned on. If the test result is "NO", the processing proceeds to step Sd3 at which pitch switch PIT is tested to determine if it is turned on. If the test result at step Sd3 is "NO", the process proceeds to step Sd4. At step Sd4, mode-setting switches MK, MA, MM (other than step-input mode-setting switch MS) are tested to determine if one of the switches is turned on. If the test result at step Sd4 is "NO", the processing proceeds to step Sd5. At step Sd5, rhythm switches RZ1 to RZ12 are tested to determine if one of the switches is turned on. If the test result at step Sd5 is "NO", the processing loops back to step Sd2. After that, steps Sd2 to Sd5 are repeatedly executed until one of accent switch ACC, pitch switch PIT, rhythm switches RZ1 to RZ12, and mode-setting switches MK, MA, and MM is turned on.

When one of the rhythm switches RZ1 to RZ12, for example, switch RZ5 (bongo) is turned on, the test result at step Sd5 is "YES", and the processing proceeds to step Sd6. At step Sd6, the following data is supplied to rhythm-sound-signal-generating circuit 19: rhythm number "5" corresponding to rhythm switch RZ5 turned on; the standard tone-pitch data PIT.F(5) in ROM 13; and standard tone-volume data ACC.F(5) in ROM 13. As a result, the rhythm-sound signals which correspond to rhythm number "5" (bongo) and have a standard tone volume and a standard tone pitch are generated and supplied to speaker 22 via amplifier 21. Thus, the rhythmical sounds of a bongo are produced from speaker 22. At the next step Sd7, the same data are written into rhythm-pattern area 15*a* in RAM 15: rhythm number "5" corresponding rhythm switch RZ5 turned on; the standard tone-pitch data PIT.F(5) in ROM 13; and standard tone-volume data ACC.F(5) in ROM 13. After that, the processing loops back to step Sd2. Similarly, when one of the rhythm switches RZ1 to RZ12 is sequentially turned on, the rhythmical sound corresponding to the rhythm switch turned on is generated, and the rhythm number, tone-pitch data and tone-volume data thereof are sequentially written into rhythm-pattern area 15*a*.

When one of rhythm switches RZ1 to RZ12 is turned on in sequence, while maintaining accent switch ACC on, rhythm switches RZ1 to RZ12 function as tone-volume-designation switches. This operation will now be described.

When accent switch ACC is turned on, the test result at step Sd2 in FIG. 11 is "YES", and the processing proceeds to step Sd8 at which data of "3" is set into register ASS. At the next step Sd9, data of "1" is set to registers SHF and STP, and the processing proceeds to multi-assign-process routine MAR in FIG. 6.

In the multi-assign-process routine MAR, steps Sb1, Sb2, Sb76, Sb77, Sb6, Sb7, Sb8, Sb79, Sb80, Sb13, and Sb81 are executed so that rhythmical sound is generated and the information corresponding to the generation is displayed. At step Sb82 in FIG. 7, the content of register STP is tested to determine if it is "1". Since the content of register STP is "1" in this case (see step Sd9 in FIG. 11), the test result at step Sb82 is "YES", and the processing returns to step Sd10 in FIG. 11. At step Sd10, the following data are written into rhythm-pattern area 15*a* in RAM 15: rhythm number in register SOUND; the tone-pitch data in register PITBUF; and tone-volume data in register ACCBUF.

When one of rhythm switches RZ1 to RZ12 is turned on in sequence, while maintaining pitch switch PIT on, rhythm switches RZ1 to RZ12 function as tone-pitch-designation switches. More specifically, when pitch switch PIT is turned on, the test result at step Sd3 in FIG. 11 is "YES", and the processing proceeds to step Sd11 at which data of "2" is set into register ASS. At the next step Sd9, data of "1" is set to registers SHF and STP, and the processing proceeds to multi-assign-process routine MAR in FIG. 6.

In the multi-assign-process routine MAR, steps Sb1, Sb2, Sb3, Sb83, Sb84, Sb6, Sb7, Sb8, Sb9, Sb85, Sb86, Sb13, Sb81, and Sb82 are executed as in KB-percussion process. After that, step Sd10 in FIG. 11 is executed, and the processing loops back to ste Sd2.

The above describes the processing of CPU 12 in the step-input mode. To transfer from the step-input mode to another mode, it is sufficient to depress one of the mode-setting switches MK, MA, and MM. This produces the test result at step Sd4 of "YES", and the processing loops back to step Sa2 in FIG. 5.

(5) AUTO-RHYTHM-PROCESS ROUTINE ARR

When mode-setting switch MA is depressed, the processing of CPU 12 proceeds to the auto-rhythm-process routine ARR. In this routine ARR, each time tempo clock TC is produced from tempo-oscillator 16, CPU 12 reads out the rhythm number, the tone-pitch data, and tone-volume data from rhythm-pattern area 15*a* in RAM 15, and supplies these data to rhythm-sound-signal-generating circuit 19. Thus, auto-rhythm performance is carried out according to the rhythm-sound data stored in rhythm-pattern area 15*a*.

As described above, the embodiment can assign a tone-pitch scale and/or a tone-volume scale to 12 rhythm switches. When the tone-pitch scale is assigned to the rhythm switches, a melody can be produced according to the tone-pitch scale. When the tone-volume scale is assigned to the rhythm switches, a more expressive percussion performance is achieved than in a conventional instrument.

Although a specific embodiment of an electronic rhythm instrument constructed in accordance with the present invention has been disclosed, it is not intended that the invention be restricted to either the specific configurations or the uses disclosed herein. Modifications may be made in a manner obvious to those skilled in the art. Accordingly, it is intended that the invention be limited only by the scope of the appended claims.

What is claimed is:

1. An electronic rhythm instrument having a plurality of rhythm switches which correspond to a plurality of rhythmical sounds, said electronic rhythm instrument generating the rhythmical sound corresponding to the rhythm switch operated, siad electronic rhythm instrument comprising:

rhythm-sound-setting means for setting one of said plurality of rhythmical sounds in such a manner that said set rhythmical sound is common to at least two of said plurality of rhythm switches;

primary-mode-setting means for setting a primary mode of operation of said electronic rhythm instrument;

secondary-mode-setting means for setting a secondary mode of operation of said electronic rhythm instrument;

assigning means including a tone pitch control data assigning means for assigning a tone pitch of a series of tone pitches to each of said at least two rhythm switches, when said primary mode is detected;

means for shifting equally all of said series of tone pitches an arbitrary pitch amount, so that the assigned tone pitch is shifted by said arbitrary pitch amount;

rhythm-sound generating means for generating said set rhythmical sound having said assigned tone pitch corresponding to an operated rhythm switch from among said at least two rhythm switches, when said secondary mode is selected;

means for storing reference data indicative of a specific tone pitch;

means for comparing said stored reference data with said assigned tone pitch; and means for providing an indication when said assigned tone pitch is greater than said reference data.

2. An electronic rhythm instrument according to claim 1, wherein said rhythm-sound-setting means has a register into which rhythmical sound data designated by one of said rhythm switches is written, and said primary-mode setting means comprises a mode-setting switch for selecting a multi-assign-process routine in which a series of tone pitches is respectively assigned to each said rhythm switch.

3. An electronic rhythm instrument according to claim 1, further comprising storing means for storing sound data representing said rhythmical sound, and wherein said secondary-mode setting means comprises a keyboard-percussion mode-setting switch, a step-input mode-setting switch, or an auto-rhythm mode-setting switch, the keyboard-percussion mode-setting switch designating a keyboard-percussion mode in which rhythmical sound is generated each time one of said rhythmic switches is operated, the step-input mode-setting switch designating a step-input mode in which rhythmical sound is generated and sound data representing said generated rhythmical sound are stored into said storing means each time one of said rhythmic switchs is operated, and the auto-rhythm mode-wetting switch designating an auto-rhythm mode in which rhythmical sounds are reproduced which are stored each time one of said rhythmic switches is operated.

4. An electronic rhythm instrument according to claim 1, further comprising a data-changing switch for changing tone-pitch-control data respectively assigned to said plurality of rhythm switches.

5. An electronic rhythm instrument having a plurality of rhythm switches which correspond to a plurality of rhythmical sounds, said electronic rhythm instrument generating the rhythmical sound correspond to the rhythm switch operated, said electronic rhythm instrument comprising:

rhythm-sound-setting means for setting one of said plurality of rhythmical sounds in such a manner that said set rhythmical sound is common to at least two of said plurality of rhythm switches;

primary-mode-setting means for setting a primary mode of operation of said electronic rhythm instrument;

secondary-mode-setting means for setting a secondary mode of operation of said electronic rhythm instrument;

assigning means including a tone pitch control data assigning means for assigning a tone pitch of a series of tone pitches to each of said at least two rhythm switches when said primary mode is selected;

means for shifting equally all of said series of tone pitches an arbitrary pitch amount, so that the assigned tone pitch is shifted by said arbitrary pitch amount;

rhythm-sound generating means for generating said set rhythmical sound having said assigned tone pitch corresponding to an operated rhythm switch from among said at least two rhythm switches, when said secondary mode is selected;

means for storing reference data indicative of a specific tone pitch;

means for comparing said stored reference data with said assigned tone pitch; and means for providing an indication when said assigned tone pitch is less than said reference data.

6. An electronic rhythm instrument according to claim 5, wherein said rhythm-sound-setting means has a register into which rhythmical sound data designated by one of said rhythm switches is written, and said primary-mode setting means comprises a mode-setting switch for selecting a multi-assign-process routine in which a series of tone pitches is respectively assigned to each said rhythm switch.

7. An electronic rhythm instrument according to claim 5, further comprising storing means for storing sound data representing said rhythmical sound, and wherein sad secondary-mode setting means comprises a keyboard-percussion mode-setting switch, a step-input mode-setting switch, or an auto-rhythm mode-setting switch, the keyboard-percussion mode-setting switch designating a keyboard-percussion mode in which rhythmical sound is generated each time one of said rhythmic switches is operated, the step-input mode-setting switch designating a step-input mode in which rhythmical sound is generated and sound data representing said generated rhythmical sound are stored into said storing means each time one of sad rhythmic switches is operated, and the auto-rhythm mode-setting switch designating an auto-rhythm mode in which rhythmical sounds are reproduced which are stored each time one of said rhythmic switches is operated.

8. An electronic rhythm instrument according to claim 5, further comprising a data-changing switch for changing tone-pitch-control data respectively assigned to said plurality of rhythm switches.

9. An electronic rhythm instrument having a plurality of rhythm switches which correspond to a plurality of rhythmical sounds, said electronic rhythm instrument generating the rhythmical sound corresponding to the rhythm switch operated, said electronic rhythm instrument comprising:

rhythm-sound-setting means for setting one of said plurality of rhythmical sounds in such a manner that said set rhythmical sound is common to at least two of said plurality of rhythm switches;

primary-mode-setting means for setting a primary mode of operation of said electronic rhythm instrument;

secondary-mode-setting means for getting a secondary mode of operation of said electronic rhythm instrument;

assigning means including a tone volume control data assigning means for assigning a tone volume of a series of tone volumes to each of said at least two rhythm switches, when said primary mode is selected;

means for shifting equally all of said series of tone volumes an arbitrary volume amount, so that the assigned tone volume is shifted by said arbitrary volume amount;

rhythm-sound generating means for generating said set rhythmical sound having said assigned tone volume corresponding to an operated rhythm switch from among said at least two rhythm switches, when said secondary mode is selected;

means for storing reference data indicative of a specific tone volume;

means for comparing said stored reference data with said assigned tone volume; and means for providing an indication when said assigned tone volume is greater than said reference data.

10. An electronic rhythm instrument according to claim 9, wherein said rhythm-sound-setting means has a register into which rhythmical sound data designated by one of said rhythm switches is written, and said primary-mode setting means comprises a mode-setting switch for selecting a multi-assign-process routine in which a series of tone volumes is respectively assigned to each said rhythm switch.

11. An electronic rhythm instrument according to claim 9, further comprising storing means for storing sound data representing said rhythmical sound, and wherein said secondary-mode setting means comprises a keyboard-percussion mode-setting switch, a step-input mode-setting switch, or an auto-rhythm mode-setting switch, the keyboard-percussion mode-setting switch designating a keyboard-percussion mode in which rhythmical sound is generated each time one of said rhythmic switches is operated, the step-input mode-setting switch designating a step-input mode in which rhythmical sound is generated and sound data representing sad generated rhythmical sound are stored into said storing means each time one of said rhythmic switches is operated, and the auto-rhythm mode-setting switch designating an auto-rhythm mode in which rhythmical sounds are reproduced which are stored each time one of said rhythmic switches is operated.

12. An electronic rhythm instrument according to claim 9, further comprising a data-changing switch for changing tone-volume-control data respectively assigned to said plurality of rhythm switches.

13. An electronic rhythm instrument having a plurality of rhythm switches which correspond to a plurality of rhythmical sounds, said electronic rhythm instrument generating the rhythmical sound corresponding to the rhythm switch operated, said electronic rhythm instrument comprising:

rhythm-sound-setting means for setting one of said plurality of rhythmical sounds in such a manner that said set rhythmical sound is common to at least two of said plurality of rhythm switches;

primary-mode-setting means for setting a primary mode of operation of said electronic rhythm instrument;

secondary-mode-setting means for setting a secondary mode of operation of said electronic rhythm instrument;

assigning means including a tone volume control data assigning means for assigning a tone volume of a series of tone volumes to each of said at least two rhythm switches, when said primary mode is selected;

means for shifting equally all of said series of tone volumes an arbitrary volume amount, so that the assigned tone volume is shifted by said arbitrary volume amount;

rhythm-sound generating means for generating said set rhythmical sound having said assigned tone volume corresponding to an operated rhythm switch from among said at least two rhythm switches, when said secondary mode is selected;

means for storing reference data indicative of a specific tone volume;

means for comparing said stored reference data with said assigned tone volume; and means for providing an indication when said assigned tone volume is less than said reference data.

14. An electronic rhythm instrument according to claim 13, wherein said rhythm-sounds-setting means has a register into which rhythmical sound data designated by one of sad rhythm switches is written, and said primary-mode setting means comprises a mode-setting switch for selecting a multi-assign process routine in which a series of tone volumes is respectively assigned to each said rhythm switch.

15. An electronic rhythm instrument according to claim 13, further comprising storing means for storing sound data representing said rhythmical sound, and wherein said secondary-mode setting means comprises a keyboard-percussion mode-setting switch, a step-input mode-setting switch, or an auto-rhythm mode-setting switch, the keyboard-percussion mode-setting switch designating a keyboard-percussion mode in which rhythmical sound is generated each time one of said rhythmic switches is operated, the step-input mode-setting switch designating a step-input mode in which rhythmical sound is generated and sound data representing said generated rhythmical sound are stored into said storing means each time one of said rhythmic switches is operated, and the auto-rhythm mode-setting switch designating an auto-rhythm mode in which rhythmical sounds are reproduced which are stored each time one of said rhythmic switches is operated.

16. An electronic rhythm instrument according to claim 13, further comprising a data-changing switch for changing tone-volume-control data respectively assigned to said plurality of rhythm switches.

* * * * *